US007878881B2

(12) United States Patent
Hendrickson

(10) Patent No.: US 7,878,881 B2
(45) Date of Patent: Feb. 1, 2011

(54) PULL UP NURSING GARMENT

(75) Inventor: Lisa A. Hendrickson, Mount Laurel, NJ (US)

(73) Assignee: Destination Maternity Corporation, Philadelphia, PA (US)

( * ) Notice: Subject to any disclaimer, the term of this patent is extended or adjusted under 35 U.S.C. 154(b) by 421 days.

(21) Appl. No.: 12/108,960

(22) Filed: Apr. 24, 2008

(65) Prior Publication Data

US 2009/0265831 A1 Oct. 29, 2009

(51) Int. Cl.
*A41C 3/04* (2006.01)

(52) U.S. Cl. ..... 450/36; 2/104; 450/30

(58) Field of Classification Search ..... 2/73, 2/113–115, 104–106; 450/30–32, 53, 55–57, 450/36, 37, 10–13, 15, 16, 18, 20, 23
See application file for complete search history.

(56) References Cited

U.S. PATENT DOCUMENTS 4,494,388 A 1/1985 Lau et al.
5,149,336 A 9/1992 Clarke et al.
5,461,725 A 10/1995 Witczak
5,611,086 A * 3/1997 Eggen ..... 2/104
6,276,175 B1 8/2001 Browder, Jr.
6,839,908 B2 * 1/2005 Schneider et al. ..... 2/73
6,854,132 B1 * 2/2005 Polzin ..... 2/104
6,855,029 B2 * 2/2005 Rothman ..... 450/36
6,983,489 B2 * 1/2006 Caprio ..... 2/69
7,076,809 B2 * 7/2006 Rothman ..... 2/104
7,077,720 B2 * 7/2006 Schneider et al. ..... 450/36
7,396,272 B1 * 7/2008 Newlen ..... 450/54
7,430,883 B2 * 10/2008 Sorensen ..... 66/176
7,448,090 B2 * 11/2008 Lucock ..... 2/104
7,488,234 B2 * 2/2009 Rothman et al. ..... 450/36
2006/0277948 A1 * 12/2006 Sorensen ..... 66/1 R

FOREIGN PATENT DOCUMENTS

DE 200 14 080 U1 12/2000

* cited by examiner

*Primary Examiner*—Gloria Hale
(74) *Attorney, Agent, or Firm*—DLA Piper LLP (US)

(57) ABSTRACT

A nursing garment is constructed with an outer bodice and an inner bodice, wherein the outer bodice is adapted for pulling up to uncover the inner bodice. The inner bodice has breast-feeding openings located for nursing and infant while wearing the inner bodice. The outer bodice provides breast cups. The outer bodice provides a bra-like support. The inner bodice is stretchable and provides a bra-like support.

28 Claims, 13 Drawing Sheets

PULL UP NURSING GARMENT

FIELD OF THE INVENTION

The present invention relates to a nursing garment, and more particularly to a nursing garment having a pull up bodice adapted for nursing an infant.

BACKGROUND

U.S. Pat. No. 6,854,132 discloses a nursing garment, including an outer garment and an inner garment. The inner garment includes two chest panels that overlap with one another in crisscross fashion. A nursing mother may raise the outer garment over her chest and pull either chest panel below her breast for breast-feeding an infant.

U.S. Pat. No. 5,461,725 discloses a garment featuring stretchable, resilient straps and a bodice. The straps and bodice are resilient and stretchable. The bodice has a resilient, stretchable bottom and a resilient, stretchable shirring on the front of the bust. The shoulder straps stretch when the bodice is pulled down to nurse an infant. The front shirring and the stretchable bottom cooperatively form a cup conforming to a breast of a wearer of the garment. A removable breast pad is attached on the inner surface of a cup using snap fasteners.

U.S. Pat. No. 6,983,489 discloses a nursing garment having breast retention panels constructed with two layers of fabric. An inner layer contains openings to insert breast cups. An outer layer provides an outer covering. The two layers are sewn together to form a pocket with an opening on the body side to provide access for receiving a pad.

U.S. Pat. No. 7,076,809 discloses a nursing garment having internal and external nursing flaps attached by respective fasteners to a shoulder strap. A built-in nursing bra is provided by internal sections comprising an elastic chest band, a soft cup frame, the internal nursing flaps, and a back piece of fabric. The internal fabric and flap can also have a pocket made of netting or made of fabric material to hold a nursing pad in place. The fasteners may include snaps, clasps or a hook and loop type fastener, in order to hold the internal and external fabric flaps, which cover the breasts and the soft cup frame.

U.S. Pat. No. 5,149,336 discloses disposable breast cups for a nursing and maternity bra. The breast cups comprise three layers; an inner fluid wicking layer, a central fluid layer and an outer moisture resistant layer.

SUMMARY OF THE INVENTION

A nursing garment has an inner bodice having breast-feeding openings located for breast-feeding an infant. An outer bodice of the garment is adapted for pulling up to uncover the inner bodice in preparation for breast-feeding, and is adapted for pulling down to cover the inner bodice.

In preparation for nursing an infant, the outer bodice is pulled up to uncover the inner bodice and the breast feeding openings. After nursing is completed, the outer bodice is adapted for pulling down to cover the inner bodice.

An embodiment of the nursing garment is advantageous to wear as an outer garment or to wear under an outer garment top, a shirt or blouse, sweater or jacket. Another embodiment of the garment is in the form of a nursing bra.

An embodiment of the invention is seamless and without fasteners that would require connection and disconnection. Another embodiment of the invention is fabricated of cut and sew knitted or woven pieces of fabric.

BRIEF DESCRIPTION OF THE DRAWINGS

Embodiments of the invention will now be described by way of example with reference to the accompanying drawings.

DETAILED DESCRIPTION

Figure 1:
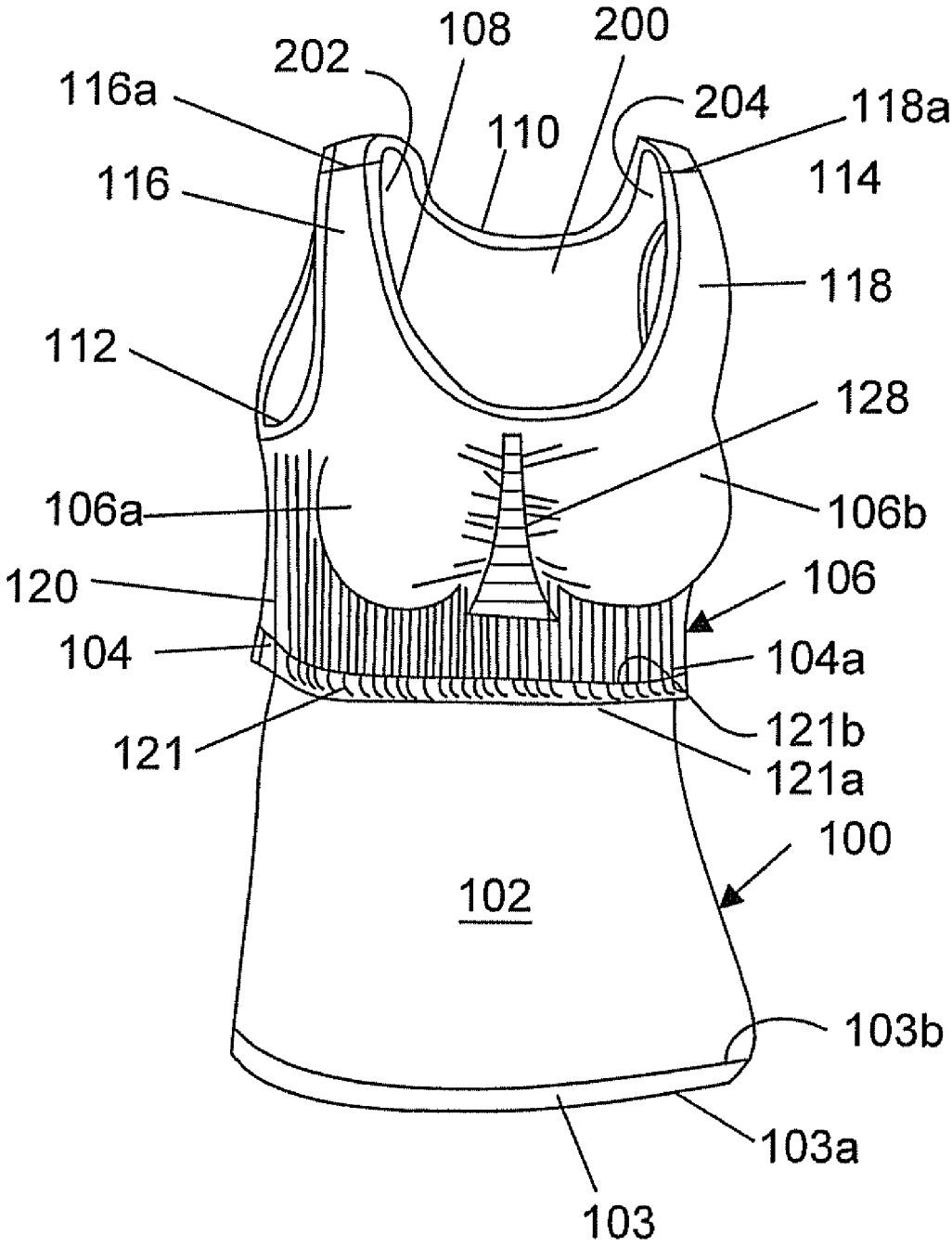
FIG. 1 is an isometric view of a nursing garment having an outer bodice and an inner bodice covered by the outer bodice.

FIG. 1 discloses a garment 100 for nursing or breast-feeding an infant. The construction of the garment 100 varies according to various garment types, including but not limited to a camisole or cami, sleepwear, dress or nursing bra. FIG. 1 discloses a bottom portion 102 of the garment 100 that has a construction including, but not limited to a camisole, sleepwear or dress, such that the construction of the bottom portion 102 varies according to the various garment types. Further, the garment 100 constructed for breast-feeding a nursing infant can be worn as a fashion top or layered under an outer garment including, but not limited to a shirt or blouse, sweater or jacket. Embodiments of the garment 100 provide a non-revealing, smooth outer appearance. According to an embodiment of the invention, the garment 100 provides a shelf bra to support a wearer's breasts.

The invention fulfills a need for a garment that is functional in terms of securing the bust area and having a nursing function, while providing modesty and an attractive appearance. Further, the invention provides a nursing garment, having soft breast cups as part of the bust area construction.

The present invention relates to a nursing garment covering at least a portion of the body between the shoulders and more or less to the waistline, with or without out a collar and sleeves, worn inside or outside a lower garment including, but not limited to a skirt. The garment is adaptable for camisoles, sleepwear and dresses. An embodiment of the garment is in the form of a nursing bra.

As disclosed by FIG. 1, the garment 100 provides an outer bodice 106 with a fashionable appearance to serve as an outer garment upper portion. Alternatively, the outer bodice 106 can be worn under an outer layer of clothing including, but not limited to a shirt, sweater or jacket. The outer bodice 106 is adapted to be pulled up in preparation for nursing without requiring removal of the outer layer of clothing.

The outer bodice 106 is a resiliently stretchable and contractible fabric, and is knitted with spandex or elastane fibers, such as LYCRA® fibers. The outer bodice 106 is seamless and tubular, and is circular knitted in one piece. The outer bodice 106 is knitted with a smooth appearance covering the breasts of the wearer. The fibers of smooth cup portions 106*a*, 106*b* of the outer bodice 106 stretch about the breasts of the wearer with a moderate amount of resilient recovery.

The outer bodice 106 has a center front stitch 128 in the form of a knitted, center front elastic band, which is stretchable and contractible, and which forms a fashion front for a fashionable appearance suitable for an outer garment. In FIG. 1, the elastic band 128 is knitted with spandex or elastane fibers. The center front elastic band 128 is knitted with a vertical rib stitch on a front side of the fabric, and is knitted with a horizontal rib stitch on a back side of the fabric, such that the knitted ribs on front and back sides, respectively, are orthogonal to one another and provide a stiffly stretchable and resilient bra-like support. The center front elastic band 128 extends lengthwise vertically from near the front neckline 108 to near the chest band 104 and attaches with stitches the outer bodice 106 to the inner panel 122, as disclosed by FIGS. 1A and 1B, which partitions the inner panel 122 into cup receiving pockets 130, 132 that retain the breast cups 124, 126, and prevent the cups from shifting positions, especially while the garment is worn. The knitted, center front elastic band 128 is relatively narrow and extends vertically between the breast cups 124, 126 such that the center front elastic band 128 extends vertically between the breasts of a wearer. An embodiment of the elastic band 128 widens laterally at the bottom thereof to provide widened lateral support below and between the wearer's breasts. Further, the center front elastic band 128 restricts undesired lateral shifting of the outer bodice 106 when worn.

The stretchable elastic inner bodice 200, the stretchable portion 122 of the outer bodice 106, the center front stitch 128 and a stretchable elastic chest band 104 each contribute to a bra-like support of the wearer's breasts, and are referred to collectively as a shelf bra. Thus, the garment 100 is adapted for wearing without a separate bra.

In FIG. 1, the chest band 104 has a circular knitted, rib stitched, torso encircling portion 104*a*. The chest band with the torso encircling portion 104*a* laterally encircles the garment to encircle a torso of a wearer of the garment 100, and extends laterally across the front of the outer bodice 106 and under the breasts of the wearer to provide a bra-like support. The torso encircling portion 104*a* is knitted with spandex or elastane fibers knitted into vertical ribs 104*a*, which can stretch resiliently and contract. A knitted vertical rib stitch on the front side of the fabric has its ribs alternating side-to-side with vertical ribs of a vertical rib stitch on the back side of the fabric. The ribs are thin or slender, fine ribs. The fabric stretches and contracts resiliently in two orthogonal directions to exert a force of resilient recovery from stretching, and to provide a desirable bra-like support.

Figure 2:
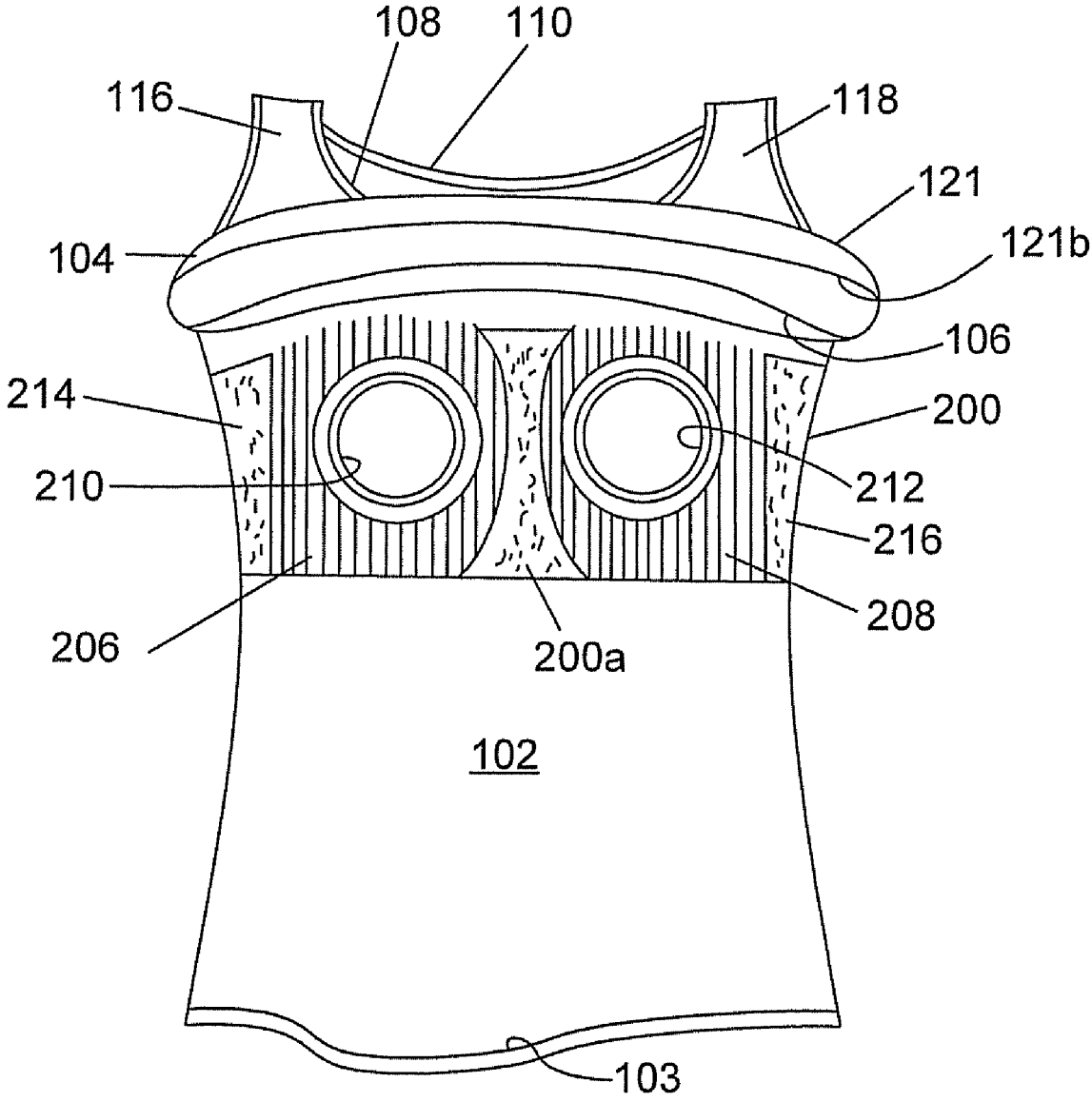
FIG. 2 is an elevation view disclosing an inner bodice uncovered by pulling up the outer bodice.

Further in FIG. 1, the outer bodice 106 is open along the bottom just below the chest band 104. The bottom hem 121 of the chest band 104 is knitted with extra spandex or elastane fibers, such as LYCRA® fibers in a diagonal rib stitch overlying the fine ribbed knit of the torso encircling portion 120. The extra spandex or elastane fibers provides elastic support under the wearer's breasts. In FIGS. 1 and 2, the bottom hem 121 is knitted with a turn back fold 121*a*, such that the bottom hem is turned back to extend inside the outer bodice 106. An edge of the turned back, bottom hem 121 is knitted with an anchoring edge stitch 121*b* to join the edge of the bottom hem 121 to the inside of the outer bodice 106. The bottom hem 121 stretches to enlarge its circumference for a wearer to put-on or remove the garment 100. The bottom hem 121 drapes downward and partially over the lower portion 102 of the garment 100. The outer bodice 106 can be worn as an outer garment top 106 or alternatively, can be worn under an outer garment top including, but not limited to a shirt or blouse, sweater or jacket.

Further in FIG. 1, the top of the outer bodice 106 has a front neckline 108 and a back neckline 110 and underarm sections 112 and 114 defining arm holes of the garment, which are edge trimmed with a facing reinforcement or binding, for example, a rolled-edge fabric reinforcement that reinforces an edge of the garment fabric, while being comfortable to the touch against a wearer's skin. The back neckline 110 can project close to the neck of a wearer, or can project downward to provide a substantially backless appearance. The front neckline 108 and the back neckline 110 are attached to spaced apart shoulder straps 116, 118 for extending over respective shoulders of a wearer, to hold the garment 100 in place over the chest. The shoulder straps 116, 118 are sufficiently long for ease in removal from the shoulders of a wearer. Opposite ends of the shoulder strap 116 are knitted unitary with the front neckline 108 and the back neckline 110, respectively. The opposite ends of the shoulder strap 116 extend upward from respective necklines 108, 110 to join along a seam 116*a*. Similarly, opposite ends of the shoulder strap 118 are knitted unitary with the front neckline 110 and the back neckline 112, respectively. The opposite ends of the shoulder strap 118 extend upward from the necklines 110, 112 to join along a seam 118*a*. In FIG. 1, the shoulder straps 116, 118 include fabric trimmed in the facing reinforcement or binding, to provide a tank top garment.

Further in FIG. 1, the outer bodice 106 is fashioned as a tank top for either a cami or a dress. For a tank top, the fabric of the outer bodice 106 extends along the shoulder straps 116, 118. The fabric of each of the shoulder straps 116, 118 is edge trimmed with a facing reinforcement, for example, a rolled-edge fabric reinforcement that reinforces an edge of the garment fabric while being comfortable to the touch against a wearer's skin. The facing reinforcement can extend continuously along an edge of the shoulder strap 116 and a corresponding edge of an underarm section 112 below an arm hole of the outer bodice 106. Similarly, the facing reinforcement can extend continuously along an edge of the shoulder strap 118 and a corresponding edge of an underarm section 114. In FIG. 1, the outer bodice 106 can be tubular and seamless, and can be a circular knit without side seams at corresponding underarm sections 112, 114.

Figure 1A:
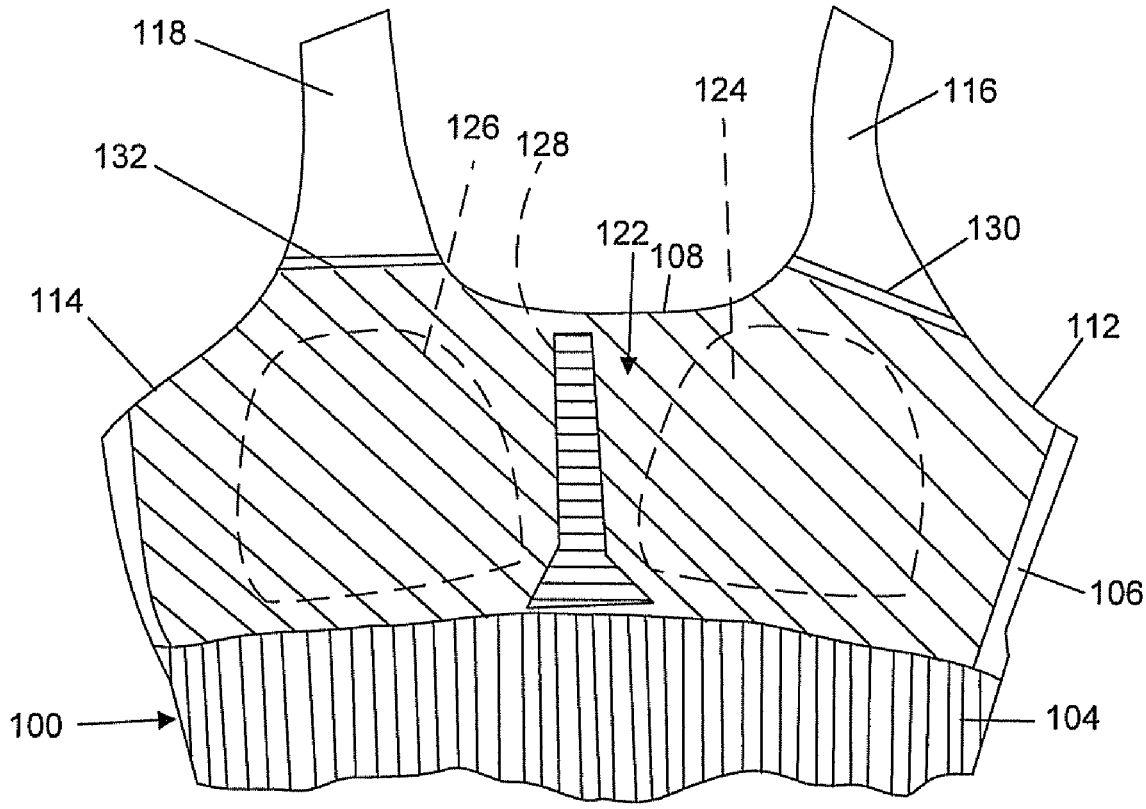
FIG. 1A is a fragmentary elevation view of an inner side or inside of the outer bodice of FIG. 1.

FIG. 1A discloses the inside of the outer bodice 106 before being sewn to the inner bodice 200 disclosed in FIGS. 1 and 2, which faces toward the wearer of the garment 100. An inner panel 122 or lining of the outer bodice 106 is indicated by diagonal lines. The inner panel 122 or lining is cut and sewn to extend vertically from the front neckline 108 to the chest band 104, and to extend laterally or horizontally across a torso of the wearer of the garment 100. The inner panel 122 or lining is constructed of a stretchable fabric, knitted or woven. The stretchable fabric includes spandex or elastane fibers, such as LYCRA® fibers. The fabric of the inner panel 122 is stretchable to undergo elastically in two orthogonal directions, and is moderately stretched elastically while being worn to support the wearer's breasts.

Further in FIG. 1A, a pair of soft padded breast cups 124, 126 are between the outer bodice 106 and the inner panel 122 or lining. The inner panel 122 is sewn to the outer bodice 106 with the interior side of a center front stitch 128 extending vertically from near the front neckline 108 to near the chest band 104, which partitions the inner panel 122 into cup receiving pockets 130, 132 that retain the cups 124, 126 and prevent the cups from shifting positions, especially while the garment is worn. The cups 124, 126 are soft to the touch and are conformable against a wearer's anatomy to provide comfort while worn. The cups 124, 126 are retained in place, and within corresponding pockets 130, 132 without fasteners, which provide a smooth and modest appearance by conforming the fabric of the garment 100 to the smooth exterior contours of the breast cups 124, 126, in the absence of fasteners that would disrupt the contour.

Further in FIG. 1A, the open tops of the pockets 130, 132 are closed by being sewn shut, such that the breast cups 124, 126 are not removable. In an alternative embodiment of FIG. 1B, the pockets 130, 132 have open tops 130*a*, 132*a*. The edges of the pockets 130, 132 are edge trimmed with a facing reinforcement, for example, a marrow stitch edge or rolled-edge fabric reinforcement that reinforces an edge of the garment fabric while being comfortable to the touch against a wearer's skin. Each of the breast cups 124, 126 is retained in a corresponding pocket 130, 132 without being sewn. Each of the breast cups 124, 126 is removable from the corresponding pocket 130, 132 for separate laundering of the breast cups 124, 126 and the garment 100, and for replacement with other breast cups 124, 126. The breast cups 124, 126 are resiliently compacted to facilitate passage through the constricted open tops 130*a*, 132*a*. The pads resiliently expand within the pockets 130, 132. Alternatively, the open tops 130*a*, 132*a* can be sewn shut to retain the breast cups 124, 126 in the pockets 130, 132.

The breast cups 124, 126 cover the wearer's breasts to cover the anatomy and provide a non-revealing smooth profile covered by a smooth portion of the outer bodice 106 extending over the smooth profiles of the breast cups 124, 126. In addition to providing a smooth and modest appearance, the breast cups 124, 126 are advantageously constructed of moisture absorbing material, and/or soft padding material. Further, each of the breast cups 124, 126 has a shaped interior contour to provide support for the breast, and to cover the breast for absorbency and modesty. Each of the breast cups 124, 126 has a shaped exterior contour providing a smooth and attractive outer appearance when covered by the outer bodice 106.

The breast cups 124, 126 are drawn against the wearer's breasts by the elastic resiliency of the torso encircling portion of the outer bodice 106 to augment the bra-like support provided by the outer bodice 106 and the knitted center front stitch 128.

A structural composition of the cups 124, 126 includes, but is not limited to natural fibers, feathers, down, polymeric fibers, polymeric foam or a combination thereof. Alternatively, an anti-bacterial composition is incorporated in the structural composition or is provided as an additive on the structural composition. Further, the cups 124, 126 are absorbent of fluid matter and are washable in detergent.

Figure 1B:
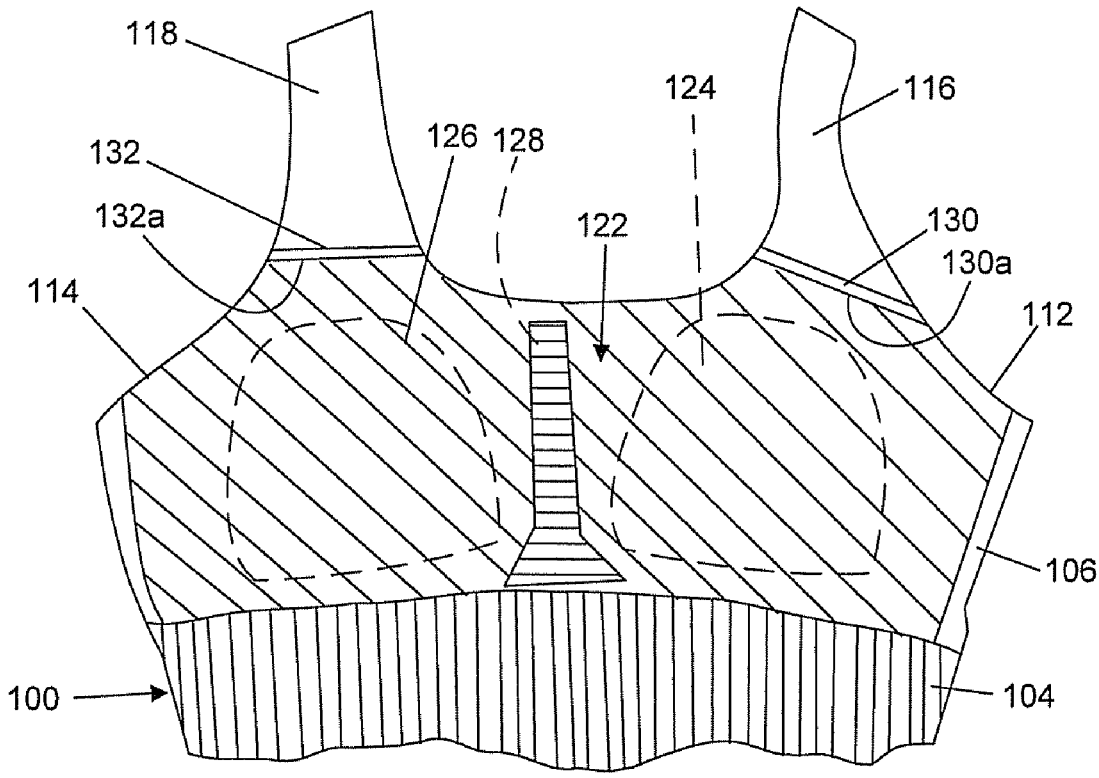
FIG. 1B is a view similar to FIG. 1A disclosing an alternative construction of the inner side or inside of the outer bodice.
Figure 1C:
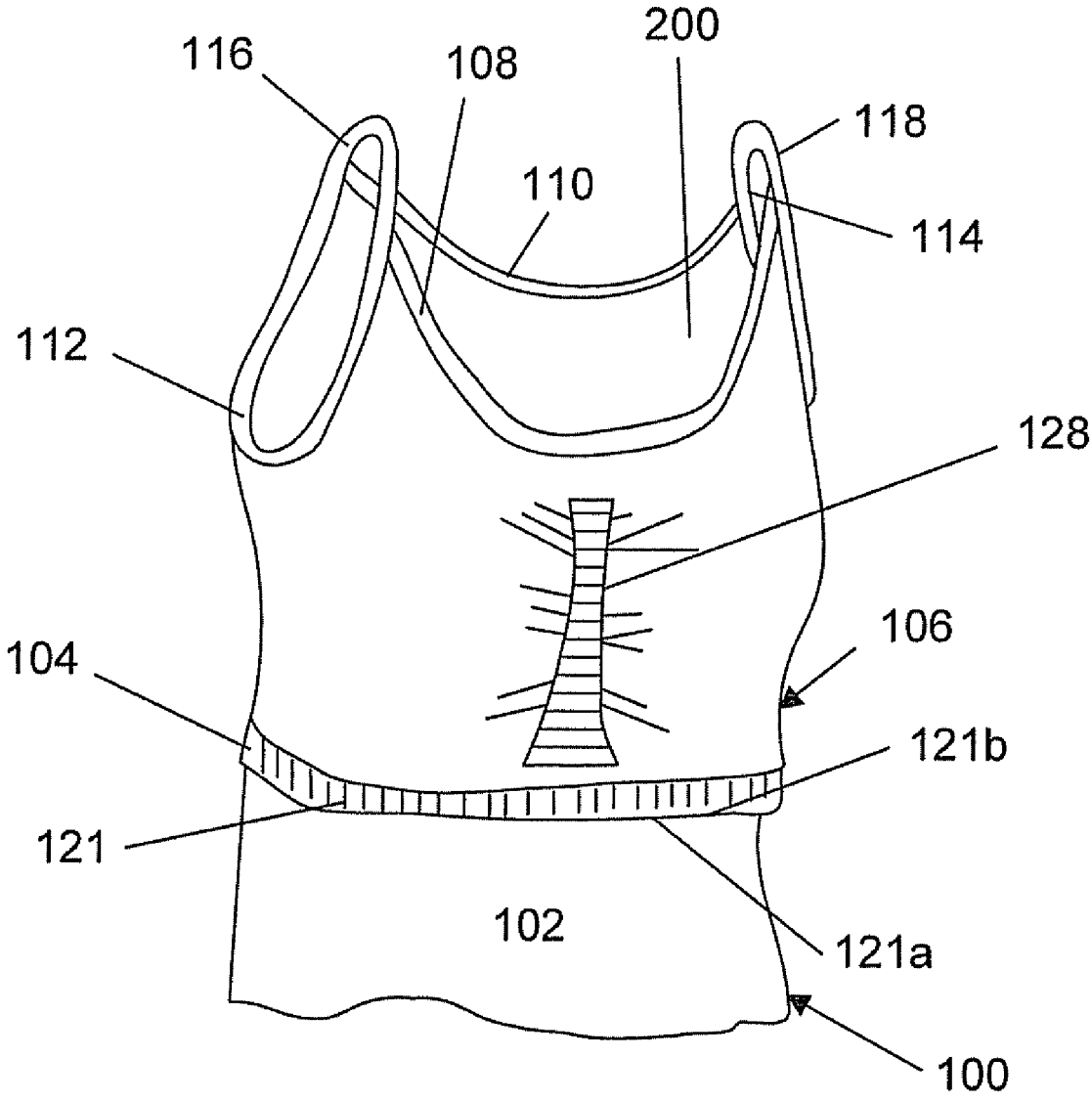
FIG. 1C is a partial isometric view of a cami style nursing garment.

In FIG. 1C, the outer bodice 106 is fashioned as a knitted cami, wherein a facing reinforcement or binding by itself provides each shoulder strap 116, 118. Additional facing reinforcement or binding extends along the front neckline 108 and a back neckline 110 and along underarm sections 112, 114. For a cami style garment, the facing reinforcement or binding can extend continuously to provide both the shoulder strap 116 and an edge trim along a corresponding edge of an underarm section 112 of the outer bodice 106. Similarly, the facing reinforcement or binding can extend continuously to provide both the shoulder strap 118 and an edge trim along a corresponding edge of an underarm section 114. The knitted cami of FIG. 1C has an interior construction similar to that disclosed in FIGS. 1A and 1B, except that the shoulder straps 116, 118 disclosed in FIGS. 1A and 1B are replaced by the shoulder straps 116, 118 disclosed in FIG. 1C.

In FIG. 1, the outer bodice 106 covers an inner bodice 200, which is in contrast to FIG. 2, wherein the outer bodice 106 is disclosed as being pulled up to uncover the inner bodice 200. The inner bodice 200 is knitted with shoulder straps 202, 204. Opposite ends of the shoulder strap 202 are knitted unitary with an inner layer of fabric having the front neckline 108 and the back neckline 110, respectively. The opposite ends of the shoulder strap 202 extend upward from respective necklines 108, 110 to join along the seam 116*a*. Similarly, opposite ends of the shoulder strap 204 are knitted unitary with an inner layer of fabric having the front neckline 108 and the back neckline 110, respectively. The opposite ends of the shoulder strap 204 extend upward from the necklines 108, 110 to join along the seam 118*a*. In FIG. 1C, for a cami style garment the shoulder strap 204 is fabricated by edge trimmed, facing reinforcement or binding, wherein the binding around the front neckline 108 and a back neckline 110 and underarm sections 112 and 114 further provides the shoulder strap 118.

Further in FIG. 1, the inner bodice 200 and the outer bodice 106 are joined by being sewn together at and along the top necklines 110, 112 and under the arms. The shoulder straps 202, 204 of the inner bodice 200 are sewn as linings under the shoulder straps 116, 118 of the outer bodice 106. The shoulder straps 202, 204 and the shoulder straps 116, 118 are for extending over respective shoulders of a wearer, to hold the inner bodice 200 and outer bodice 106 in place over the chest.

In FIG. 2, the inner bodice 200 and the bottom portion 102 are seamless and tubular and are circular knitted in one piece to have respective circumferences that completely encircle the garment 100 and the torso of the wearer. The fabric is knitted of a two-way stretchable material, stretchable in two orthogonal directions, suitably soft to the touch and flexible to drape about a wearer's body.

With reference to FIGS. 1 and 2, the bottom portion 102 has a bottom hem 103 knitted with a turn back fold 103*a*, such that the bottom hem 103 is turned back inside the bottom portion 102. An edge of the bottom hem 103 is turned back, and is knitted or seamed with an anchoring edge stitch 103*b* to join the edge of the bottom hem 103 to the inside of the bottom portion 102.

In FIG. 2, the inner bodice 200 is without a chest band. In an alternative construction, FIG. 8 discloses a chest band 704 that can be added to the inner bodice 200, either as a separate cut and sew piece, or by gathering the fabric to form a casing encircling the inner bodice 200 at a desired location of the chest band 704, and encasing a reinforcing elastic band in a manner as described below with reference to FIG. 8.

Further in FIG. 2, the inner bodice 200 has spaced apart, breast-feeding openings 210, 212 each knitted with, for example, a marrow stitch edge. The openings 210, 212 extend through the inner bodice 200, and are located to expose respective portions of the wearer's breasts for nursing an infant through the inner bodice 200 while wearing the inner bodice 200. Alternatively, in FIG. 2 the inner bodice 200 provides breast supporting sections 206, 208 encircling respective openings 210, 212. The breast supporting sections 206, 208 are separated by a center front section 200*a* of the inner bodice 200 to provide individual breast support. The breast supporting sections are knitted with spandex or elastane fibers knitted into vertical ribs. The ribs are thin or slender, fine ribs. The fabric stretches and contracts resiliently in two orthogonal directions to provide a desirable support for engaging and supporting a wearer's breasts.

The fabric of the inner bodice 200 in FIG. 2 is knitted with fine ribbed, torso engaging sections 214, 216 adjacent to the breast supporting sections 206, 208. The torso engaging sections are stretchable resiliently, and contract resiliently, in two orthogonal directions against a wearer's torso, and engage the torso under the arms of the wearer. Alternatively, the inner bodice 200 in FIG. 2 can be made as a plain stitch knit, or made as cut and sew pieces with side seams. The stretchable elastic inner bodice 200 in FIG. 2, the stretchable elastic outer bodice 106 in FIGS. 1, 1A and 1B and the center front elastic band of the center front stitch 128 in FIGS. 1, 1A and 1B, together provide a bra-like support of the wearer's breasts, and are referred to as a shelf bra. Thus, the garment 100 is adapted for wearing without a separate bra.

In FIG. 2, the breast-feeding openings 210, 212 are located to expose respective portions of the wearer's breasts for nursing an infant while wearing the inner bodice 200. FIG. 2 discloses that the shoulder straps 116, 118 of the outer bodice 106 can remain on corresponding shoulders of the wearer, while the outer bodice 106 is pulled up to uncover the openings 210, 212 for nursing an infant through the inner bodice 200. The breast cups 124, 126 disclosed in FIGS. 1A and 1B are resiliently deformable to minimize resistance to being pulled up with the outer bodice 106. Advantageously, the outer bodice 106 can be worn under an outer garment top including, but not limited to a blouse, sweater or jacket that can pulled up with the outer bodice 106. Thus, the outer garment top can be worn while the outer bodice 106 is pulled up in preparation for nursing an infant. The garment 100 avoids a need for removal of the outer garment top or removal of the outer bodice 106 in preparation for nursing an infant.

Further in FIG. 2, the entire outer bodice 106 can be pulled up in preparation for nursing an infant, or alternatively, one side of the outer bodice 106 can be pulled up to uncover a wearer's breast on one side in preparation for nursing. In preparation for nursing, to breast-feed an infant held in one of the arms of a wearer, the wearer reaches her hand of the other arm to pull up one side of the outer bodice 106 to uncover a portion of the inner bodice 200 and to uncover one of the wearer's breasts for nursing the infant at the breast on one side. During nursing, the inner bodice 200 is held up by the shoulder straps 202, 204 that are further disclosed in FIGS. 1 and 2. The inner bodice 200 is held down by the bottom garment portion 102. After nursing on the one side is completed, the outer bodice 106 is pulled down to cover the inner bodice 200 and provide support for the wearer's breasts.

Figure 3:
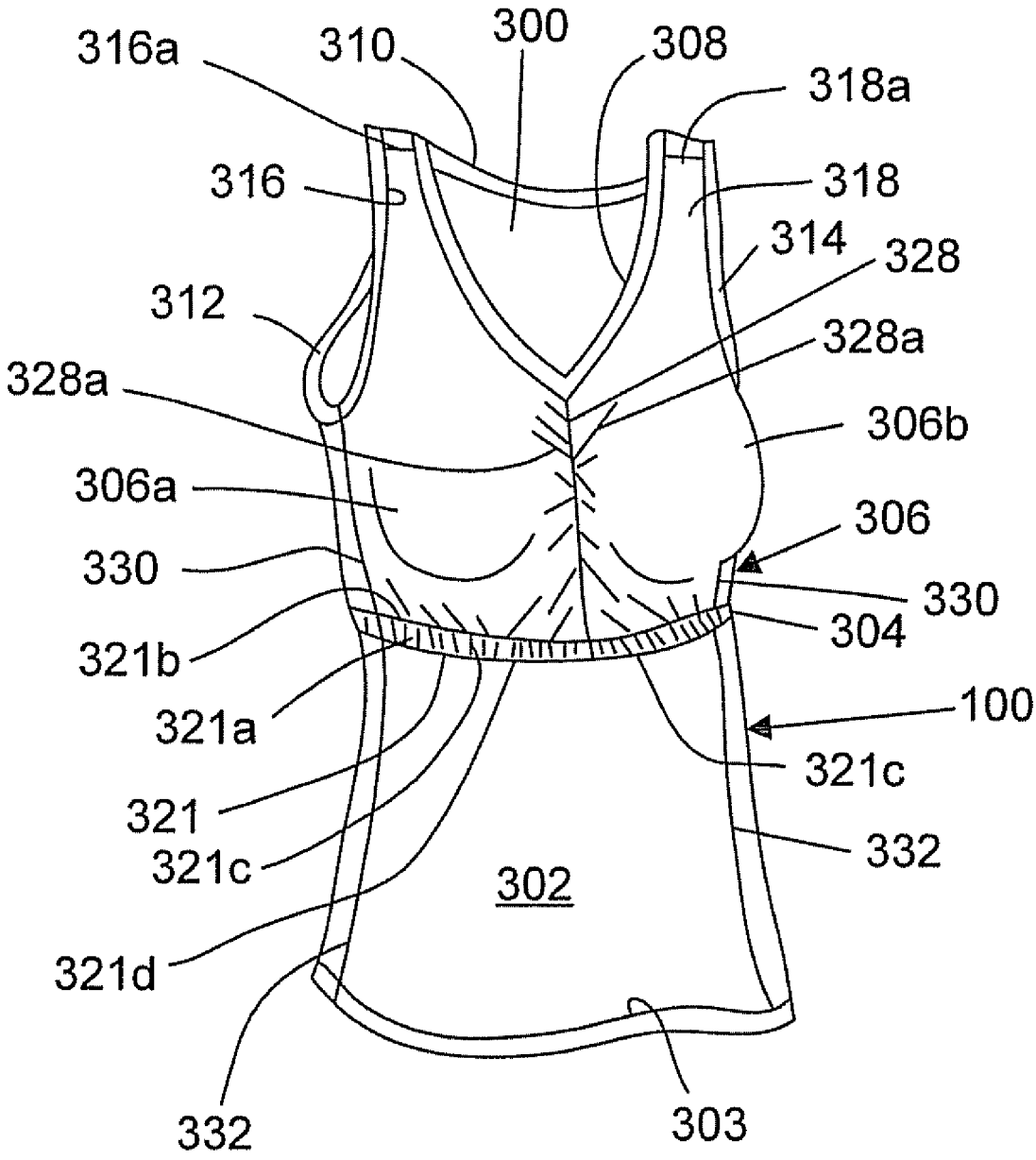
FIG. 3 is an elevation view of a cut and sew nursing garment having an outer bodice and an inner bodice covered by the outer bodice.

FIG. 3 discloses a different version of the garment 100 wherein a cut and sew garment 100 has an outer bodice 306 fabricated with cut and sew fabric pieces that are sewn together along side seams 330 in the outer bodice 306. The fabric pieces can be either woven or knitted fabric. Further, the fabric pieces are sewn together along seams 316*a*, 318*a* across respective shoulder straps 316, 318. In FIG. 3, a front neckline 308 of the outer bodice 306 has a V-shape. Shown are a front neckline 308 and a back neckline 310, and underarm sections 312 and 314 defining arm holes of the garment, which are edge trimmed with a facing reinforcement or binding, for example, a rolled-edge fabric reinforcement that reinforces an edge of the garment fabric while being comfortable to the touch against a wearer's skin. The facing reinforcement or binding can have a high gloss or sheen appearance.

Further in FIG. 3, the outer bodice 306 is a resiliently stretchable and contractible fabric, and is woven or knitted with spandex or elastane fibers, such as LYCRA® fibers. The outer bodice 306 is woven or knitted with a smooth appearance covering the breasts of the wearer. The fibers of smooth cup portions 306*a*, 306*b* of the outer bodice 306 stretch about the breasts of the wearer with a moderate amount of resilient recovery.

Figure 3A:
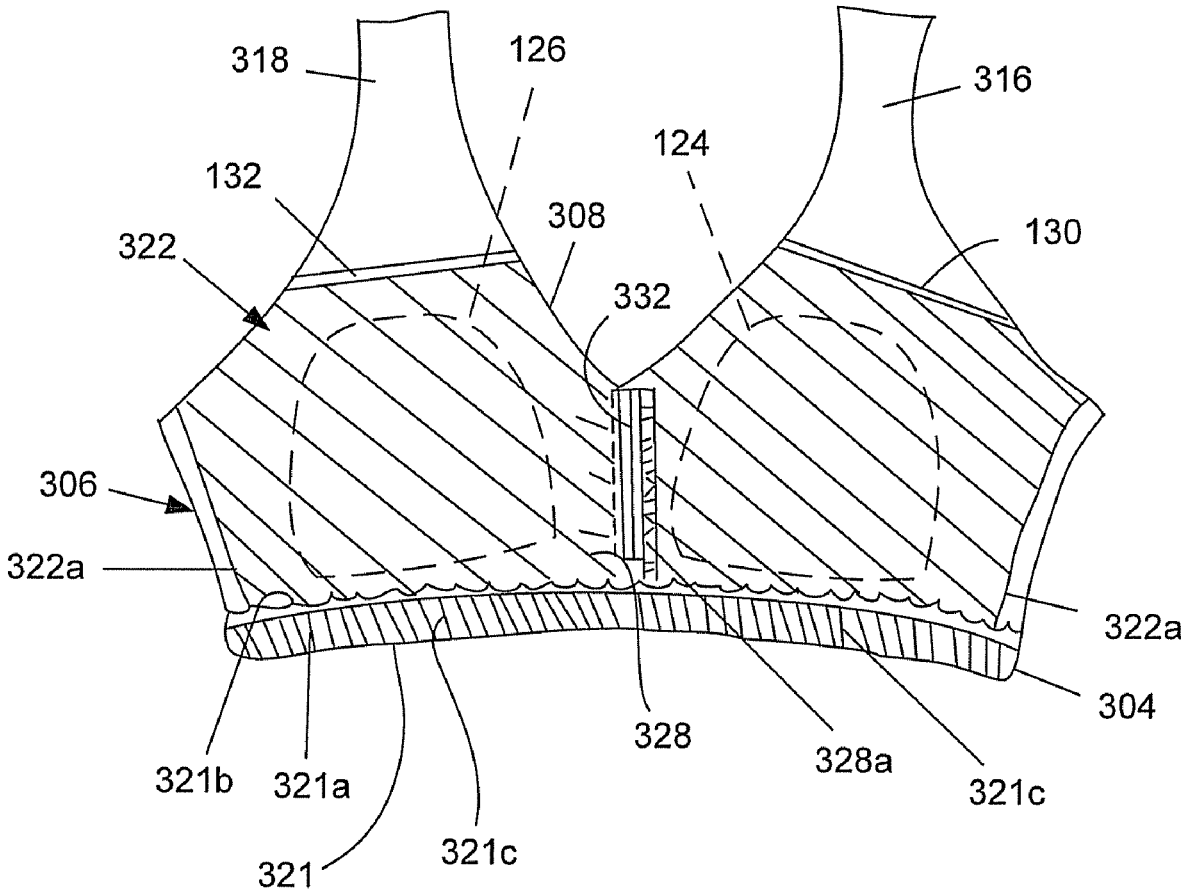
FIG. 3A is a fragmentary elevation view of an inner side or inside of the outer bodice of FIG. 3.

FIG. 3A discloses the inside of the outer bodice 306 before being sewn to the inner bodice 300 that is shown in FIG. 3. The inside of the outer bodice 306 faces toward the wearer of the garment 100. An inner panel 322 or lining of the outer bodice 306 is indicated by diagonal lines. The inner panel 322 or lining is cut and sewn to extend vertically from the front neckline 308 to the chest band 304, and to extend laterally or horizontally across a torso of the wearer of the garment 100 to side seams 322*a*. The inner panel 322 or lining is constructed of a stretchable fabric, knitted or woven. The stretchable fabric includes spandex or elastane fibers, such as LYCRA® fibers. The fabric of the inner panel 322 is stretchable to undergo elastically in two orthogonal directions, and is moderately stretched elastically while being worn to support the wearer's breasts.

Figure 4:
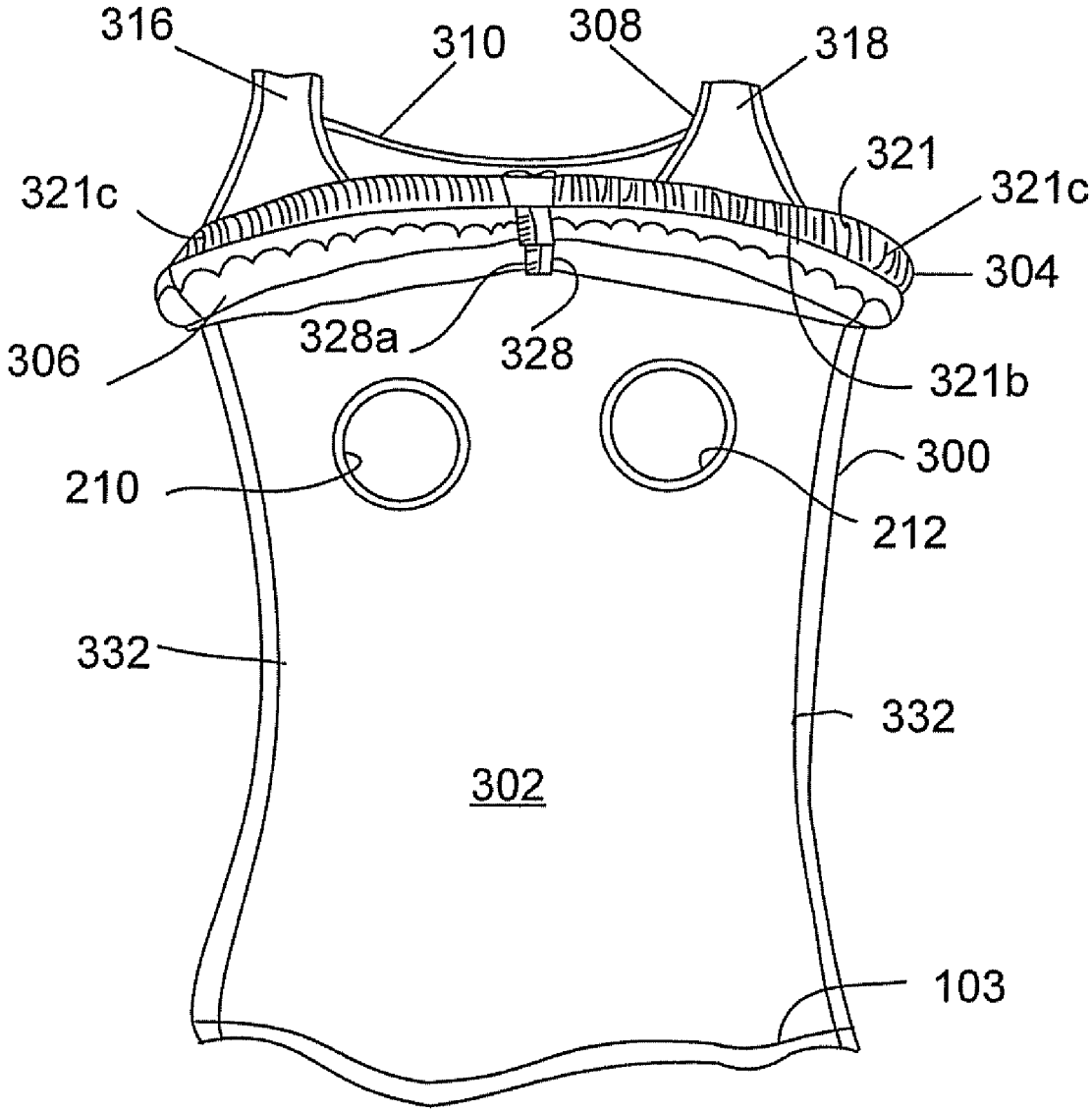
FIG. 4 is an elevation view disclosing an inner bodice uncovered by pulling up the outer bodice of FIG. 3.

In FIG. 4, an inner bodice 300 and a bottom portion 302 are fabricated integrally together with cut and sew fabric pieces that are sewn together along side seams 332. The bottom portion 302 has a sewn bottom hem 303.

Further in FIG. 3, the outer bodice 306 has a center front stitch 328 in a cut and sew version of the outer bodice 306. The center front stitch 328 is formed by gathering the fabric of the elastic outer bodice 306 along a vertical, center front line and forming a series of horizontal, random pleats 328*a* that originate from gathering the fabric along the center front line. Further the center front stitch 328 is formed by gathering the fabric of the inner panel 322 in FIG. 3A, together with gathering the outer bodice 306 along the center front line. Then the gathered fabric is sewn along the center front line. Further in FIG. 3A, the edges of the fabric near the center front stitch 328 are further stitched together and hemmed at 328*a*. An optional elastic band 332 is sewn vertically and adjacent to the center front stitch 328 to increase the upward support provided by the outer bodice 306. The center front stitch 328 is relatively narrow and extends vertically between the breast cups 124, 126 such that the center front stitch 328 extends vertically between the breasts of a wearer to provide support for the breasts. Further, the center front stitch 328 restricts undesired lateral shifting of the outer bodice 306 when worn.

Further in FIG. 3A, another version of a center front stitch 328 in a cut and sew version is elastic reinforced, and is formed by inserting a lengthwise strip of elastic, for example, a short length strip of elastic extending lengthwise vertically along the vertical, center front line, followed by gathering the fabric of the inner panel 322 for a sufficient length and width to cover the strip of elastic, and then sewing the gathered fabric along the center front line.

Further in FIG. 3, the center front stitch 328 extends lengthwise vertically from near the front neckline 308 to near the chest band 304 and sews the outer bodice 306 to an inner panel 322, as disclosed by FIG. 3A. The fabric of the center front stitch 328 is stretchable and contractible, and forms a fashion front for a fashionable appearance suitable for an outer garment.

Further in FIG. 3A, the center front stitch 328 partitions the inner panel 322 into cup receiving pockets 130, 132 the same as disclosed in FIG. 1A or in FIG. 1B, that retain respective cups 124, 126 the same as disclosed in FIG. 1A or in FIG. 1B, and prevent the cups from shifting positions, especially while the garment is worn.

The stretchable elastic inner bodice 300, the stretchable outer bodice 306, the center front stitch 328 and a stretchable elastic chest band 304, FIGS. 3 and 3A, each contribute to a bra-like support of the wearer's breasts, and are referred to collectively as a shelf bra. Thus, the garment 100 is adapted for wearing without a separate bra.

Figure 7:
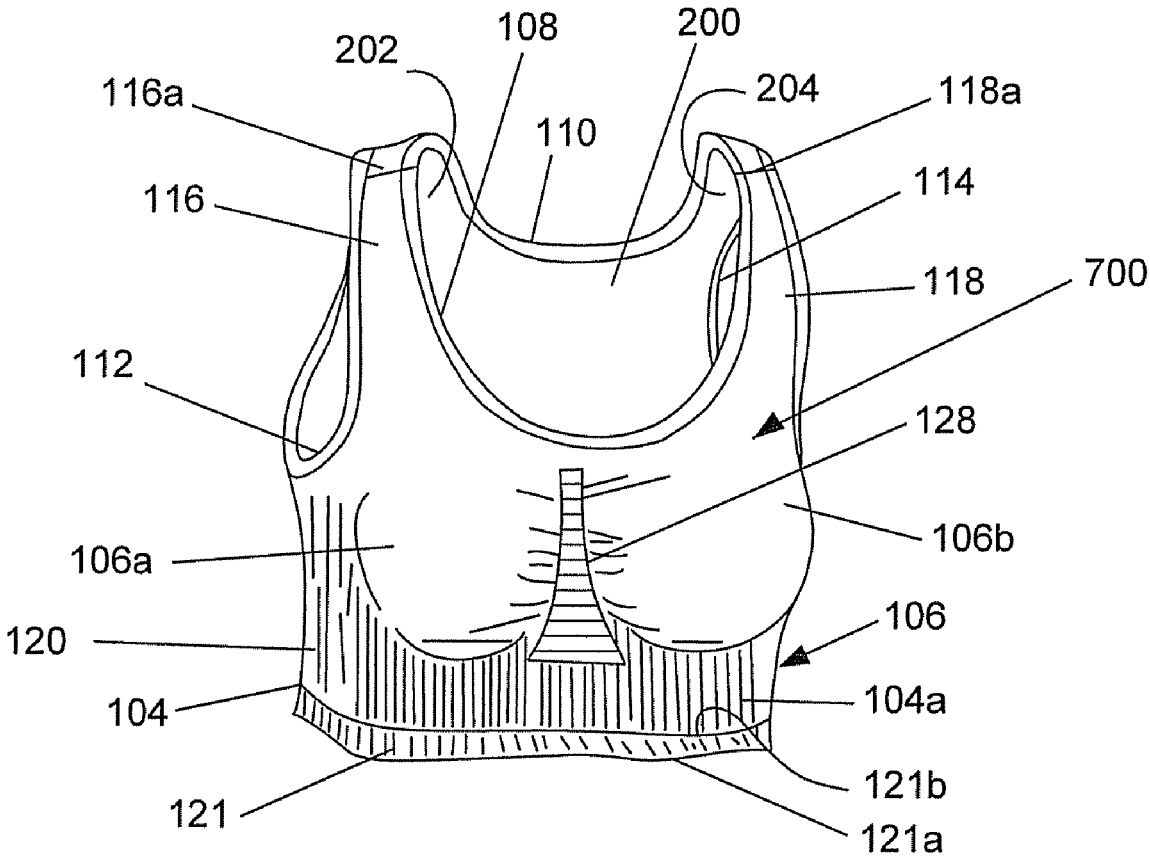
FIG. 7 is an elevation view of an additional alternative construction of a nursing garment.

To fabricate alternative embodiments, the center front stitch 328 and the center front stitch 128 are interchangeable with each other in any of the embodiments of the outer bodice 106, 306 and 706 in FIG. 7.

In FIGS. 3 and 3A, the chest band 304 is formed on the outer bodice 306 by turning back a bottom hem 321 to the inside to form a hollow casing 321*a*. The casing 321*a* is reinforced by a stretchable elastic band formed into a hoop encircling the outer bodice 306 to encircle a torso of the wearer. The hollow casing 321*a* is sewn with an anchoring end stitch 321*b* along the edge of the turned back hem 321 to encase the elastic band. The hoop formed by the elastic band is smaller in circumference than the bottom hem 321, such that the hem 321 gathers into multiple pleats 321*c* to gather and shrink the circumference of the bottom hem 321 to the smaller circumference of the hoop formed by the elastic band. Additional pleats 321*d* form in a torso encircling portion of the outer bodice 306 adjacent to the bottom hem 321. The elastic band is stretchable to expand the hoop and the pleats 321*c* expand or unfold to expand the circumference of the bottom hem 321, for passage of the garment 100 over the head of the wearer while putting on or taking off the garment 100.

In FIG. 3A a pair of soft padded breast cups 124, 126 are between the outer bodice 306 and the inner panel 322 or lining. The inner panel 322 is sewn to the outer bodice 306 with the interior side of the center front stitch 328 extending vertically from near the front neckline 308 to near the chest band 304, which partitions the inner panel 322 into the cup receiving pockets 130, 132 that retain the cups 124, 126 and prevent the cups from shifting positions, especially while the garment is worn. The cups 124, 126 are soft to the touch and are conformable against a wearer's anatomy to provide comfort while worn. The cups 124, 126 are retained in place, and within corresponding pockets 130, 132 without fasteners, which provides a smooth and modest appearance by conforming the fabric of the garment 100 to the smooth exterior contours of the breast cups 124, 126 in the absence of fasteners that would disrupt the contour.

In FIG. 3A the open tops of the pockets 130, 132 are closed by being sewn shut, such that the breast cups 124, 126 are not removable. In an alternative embodiment, the pockets 130, 132 have open tops similarly as disclosed in FIG. 1B. Further details of the pockets with open tops are discussed previously with reference to FIG. 1B.

The breast cups 124, 126 cover the wearer's breasts to cover the anatomy and provide a non-revealing smooth profile covered by a smooth portion of the outer bodice 306 extending over the smooth profiles of the breast cups 124, 126. In addition to providing a smooth and modest appearance, the breast cups 124, 126 are advantageously constructed of moisture absorbing material, and/or soft padding material. Further, each of the breast cups 124, 126 has a shaped interior contour to provide support for the breast, and to cover the breast for absorbency and modesty. Each of the breast cups 124, 126 has a shaped exterior contour providing a smooth and attractive outer appearance when covered by the outer bodice 306.

The breast cups 124, 126 are drawn against the wearer's breasts by the elastic resiliency of the torso encircling portion of the outer bodice 306 to augment the bra-like support provided by the outer bodice 306, chest band 304 and the center front stitch 328.

In FIG. 4, the inner bodice 300 has spaced apart, breast-feeding openings 210, 212, similarly as disclosed by FIG. 2, and each knitted with, for example, a marrow stitch edge. The openings 210, 212 extend through the inner bodice 300, and are located to expose respective portions of the wearer's breasts for nursing an infant through the inner bodice 200 while wearing the inner bodice 200. In FIG. 4, the outer bodice 306 is pulled up to reveal the inner bodice 200 in preparation for nursing.

The fabric of the inner bodice 300 can be made of a woven or knitted unribbed fabric, or alternatively, the inner bodice 300 is woven or knitted with the ribs of the breast supporting sections 206, 208 as in the embodiment disclosed by FIG. 2, encircling respective openings 210, 212. In FIG. 2, the breast supporting sections 206, 208 are separated by a center front section 200*a* of the inner bodice 200 to provide individual breast support. The breast supporting sections are knitted with spandex or elastane fibers knitted into vertical ribs. The ribs are thin or slender, fine ribs. The fabric stretches and contracts resiliently in two orthogonal directions to provide a desirable support for engaging and supporting a wearer's breasts.

Further in FIG. 3, the fabric of the inner bodice 300 can be made of cut and sew pieces with side seams 332. Alternatively, the inner bodice 300 can be similar to the inner bodice 200, FIG. 2, by being knitted with fine ribbed, torso engaging sections 214, 216 adjacent to the breast supporting sections 206, 208. The torso engaging sections 214, 216 are stretchable resiliently, and contract resiliently in two orthogonal directions against a wearer's torso, and engage the torso under the arms of the wearer. The stretchable elastic inner bodice 300, the stretchable elastic outer bodice 306 and center front elastic band of the center front stitch 328, together provide a bra-like support of the wearer's breasts, and are referred to as a shelf bra. Thus, the garment 100 of FIG. 3 is adapted for wearing without a separate bra.

Figure 5:
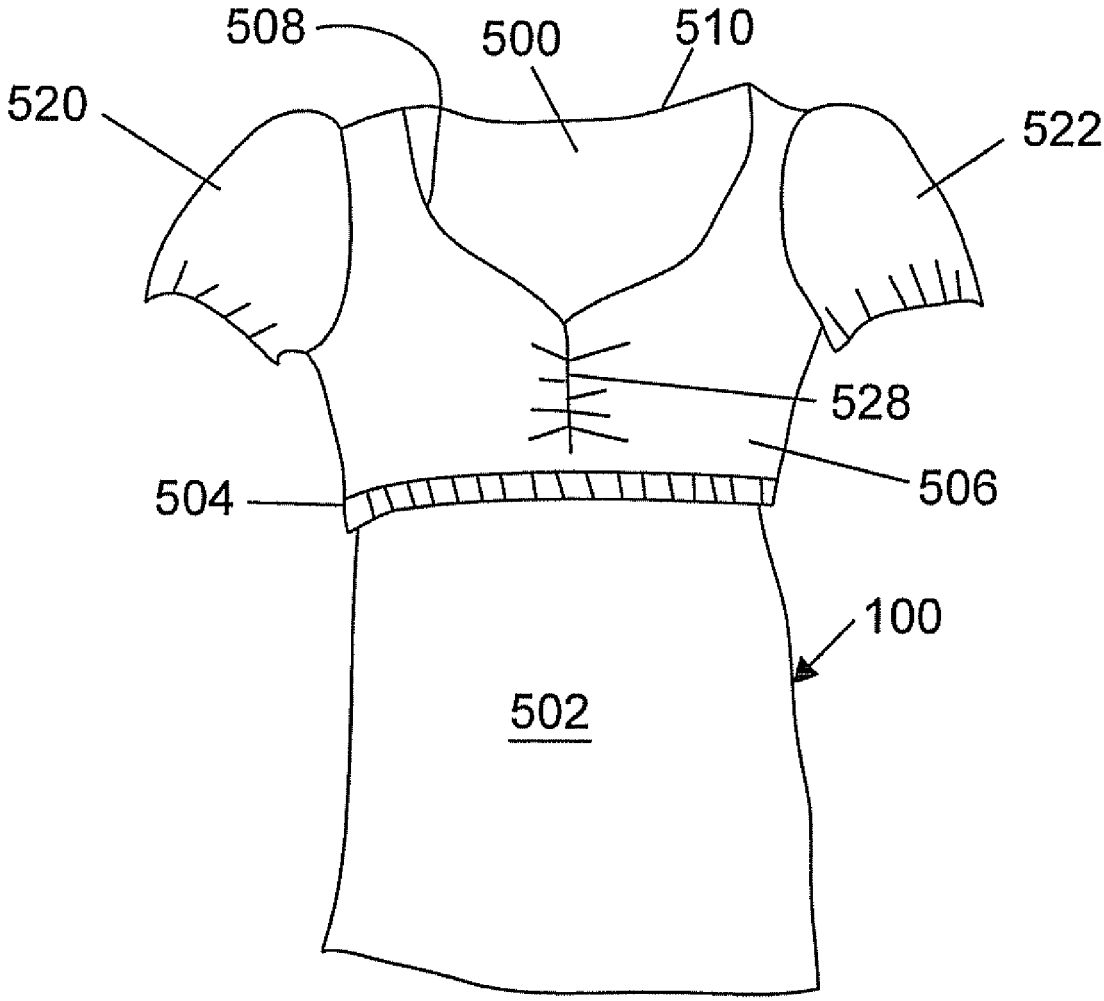
FIG. 5 is an elevation view of an alternative construction of a nursing garment.

FIG. 5 discloses a different version of a nursing garment 100 in the form of a dress, wherein the bottom garment portion 502 is a skirt portion of a dress that is knitted or cut and sewn. An outer bodice 506 has a front neckline 508 and a back neckline 510 having a turned back, plain hem, without an edge trim reinforcement. Alternatively, the front neckline 508 can have the same construction as the front neckline 108 or 308 of previously disclosed embodiments of the invention. Alternatively, the back neckline 510 can have the same construction as either the back neckline 110 or 310 of previously disclosed embodiments of the invention. Further, sleeves 520, 522 are sewn in place of the under arm sections 112, 114 or 312, 314 of previously disclosed embodiments of the invention. The sleeves 520, 522 are either short in length to provide short sleeves or lengthened to provide long sleeves. An outer bodice 506 can have the same construction as the outer bodice 106 or 306 of previously disclosed embodiments of the invention. An inner bodice 500 can have the same construction as the inner bodice 200 or 300 of previously disclosed embodiments of the invention. A bottom portion 502 of the garment 100 can have the same construction as the bottom portion 102 or 302 of previously disclosed embodiments of the invention. A center front stitch 528 can have the same construction as the center front stitch 128 or 328 of previously disclosed embodiments of the invention. A chest band 504 can have the same construction as the chest band 104 or 304 of previously disclosed embodiments of the invention.

Figure 6:
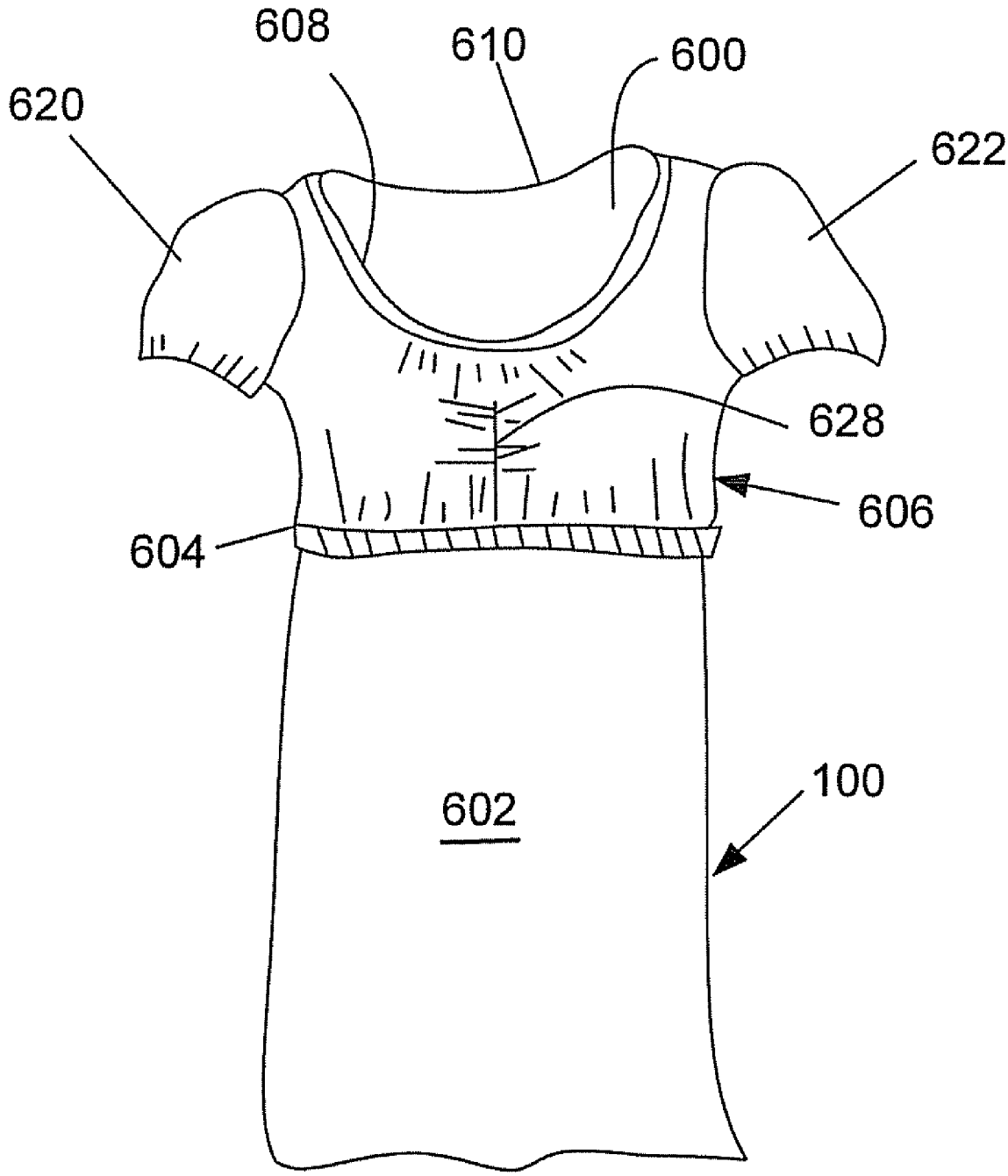
FIG. 6 is an elevation view of a further alternative construction of a nursing garment.

FIG. 6 discloses a different version of a nursing garment 100 in the form of a dress, wherein the garment bottom portion 602 is a skirt portion of a dress that is knitted or cut and sewn. An outer bodice 606 has a front neckline 608, which can have the same construction as one of the necklines 108, 308 or 508 of previously disclosed embodiments of the invention. A back neckline 610 can have the same construction as one of the necklines 110, 310 or 510 of previously disclosed embodiments of the invention. Further, sleeves 620, 622 are sewn in place of the under arm sections 112, 114 or 312, 314. The sleeves 620, 622 are either short in length to provide short sleeves or lengthened to provide long sleeves. The outer bodice 606 can have the same construction as the outer bodice 106 or 306 of previously disclosed embodiments of the invention. An inner bodice 600 can have the same construction as the inner bodice 200 or 300 of previously disclosed embodiments of the invention. A bottom portion 602 can have the same construction as the bottom portion 102 or 302 of previously disclosed embodiments of the invention. A center front stitch 628 can have the same construction as the center front stitch 128 or 328 of previously disclosed embodiments of the invention. A chest band 604 can have the same construction as the chest band 104 or 304 of previously disclosed embodiments of the invention.

Figure 8:
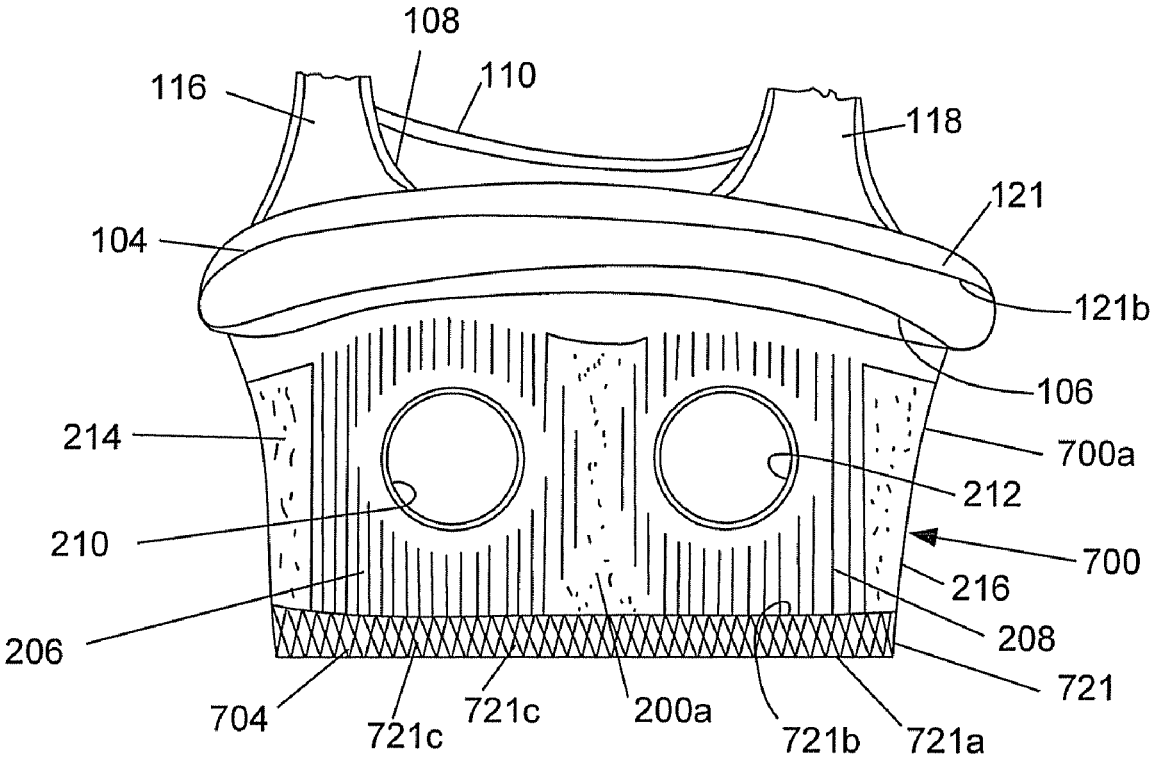
FIG. 8 is an elevation view of the nursing garment of FIG. 7 with an outer bodice pulled up to uncover an inner bodice in preparation for nursing.

FIG. 7 discloses a different version of a nursing garment 700 in the form of a nursing bra 700 to be worn as an undergarment or, alternatively, as an outer garment top. The nursing garment 700 has an outer bodice 106 with a chest band 104 similar to that disclosed by FIGS. 1, 1A and 1B. Further, the outer bodice 106 in FIG. 7 has a front center stitch 128, wherein the front construction and further details of the outer bodice 106 are described above with reference to FIGS. 1, 1A and 1B. Alternatively, the nursing garment 700 can have an outer bodice 106 as described in FIG. 1C. With reference to FIGS. 7 and 8, the nursing garment 700 has an inner bodice 700*a* without having a bottom portion 102, 302, 502 or 602 as disclosed by FIGS. 1, 3, 5 and 6, respectively. The stretchable elastic inner bodice 700*a*, the stretchable elastic outer bodice 106, chest band 104 and the center front stitch 128, together provide a bra-like support of the wearer's breasts.

With further reference to FIGS. 7 and 8, the fabric of the inner bodice 700*a* is knitted of a two-way stretchable material, stretchable in two orthogonal directions, suitably soft to the touch and flexible to drape about a wearer's body. According to an embodiment, the inner bodice 700*a* is seamless and tubular and is circular knitted in one piece with a circumference that completely encircles the nursing garment 700 and the torso of the wearer. The fabric of the inner bodice 700*a* is knitted of a two-way stretchable material, stretchable in two orthogonal directions, suitably soft to the touch and flexible to drape about a wearer's body.

In FIG. 8, the inner bodice 700*a* has spaced apart, breast-feeding openings 210, 212 similarly as disclosed in FIG. 2. Each of the openings 210, 212 in FIG. 8 is knitted with, for example, a marrow stitch edge. The openings 210, 212 extend through the inner bodice 700*a*, and are located to expose respective portions of the wearer's breasts for nursing an infant through the inner bodice 700*a* while wearing the inner bodice 700*a*. Alternatively, in FIG. 8, the inner bodice 700*a* provides breast supporting sections 206, 208 encircling respective openings 210, 212. The breast supporting sections 206, 208 are separated by a center front section 200*a* of the inner bodice 700*a* to provide individual breast support. The breast supporting sections 206, 208 are knitted with spandex or elastane fibers knitted into vertical ribs. The ribs are thin or slender, fine ribs. The fabric stretches and contracts resiliently in two orthogonal directions to provide a desirable support for engaging and supporting a wearer's breasts.

The fabric of the inner bodice 700*a* can be made of a plain stitch knit or can be made of cut and sew pieces sewn with side seams of previously disclosed embodiments of the invention. Alternatively, in FIG. 8 the inner bodice 700*a* is knitted with fine ribbed, torso engaging sections 214, 216 adjacent to the breast supporting sections 206, 208. The torso engaging sections 214, 216 stretch and contract resiliently in two orthogonal directions against a wearer's torso, and engage the torso under the arms of the wearer.

In FIG. 8, the breast-feeding openings 210, 212 are located to expose respective portions of the wearer's breasts for nursing an infant while wearing the inner bodice 700*a*. FIG. 8 discloses that the shoulder straps 116, 118 of the outer bodice 106 can remain on corresponding shoulders of the wearer, while the outer bodice 106 is pulled up to uncover the openings 210, 212 for nursing an infant through the inner bodice 700*a*. The breast cups 124, 126 are further described with reference to FIG. 1A, and are resiliently deformable to minimize resistance to being pulled up with the outer bodice 106. Advantageously, the nursing garment 700 having the outer bodice 106 can be worn as an outer garment 700 or, alternatively, as an undergarment under an outer garment top including, but not limited to a blouse, sweater or jacket that can be pulled up with the outer bodice 106. Thus, the outer garment top can be worn and pulled up while the outer bodice 106 is pulled up in preparation for nursing an infant. The garment 700 avoids a need for removal of the outer garment top or removal of the outer bodice 106 in preparation for nursing an infant.

Further in FIG. 8, the fabric of the inner bodice 700*a* is the same as described with reference to the inner bodice 200 of FIG. 2 to provide a bra-like support. Further, the inner bodice 700*a* is fabricated with an elastic reinforced, tubular seamless chest band 704 to extend under the bust of a wearer. Further, the chest band 704 extends circumferentially around the torso of the wearer to provide a bra-like support. The chest band 704 is formed on the inner bodice 700*a* by turning back a bottom hem 721 of the inner bodice 700*a* to the inside to form a hollow casing 721*a*. The casing 721*a* is reinforced internally by a stretchable elastic band formed into a hoop encircling the inner bodice 700*a* to encircle a torso of the wearer. The hollow casing 721*a* is sewn with an anchoring end stitch 721*b* along the edge of the turned back hem 721 to encase the elastic band. The hoop formed by the elastic band is smaller in circumference than the bottom hem 721, such that the hem 721 gathers into multiple pleats 721*c* to gather and shrink the circumference of the bottom hem 721 to the smaller circumference of the hoop formed by the elastic band. The elastic band is stretchable to expand the hoop, and the pleats 721*e* expand or unfold to expand the circumference of the bottom hem 721, for passage of the garment 700 over the head of the wearer while putting on or taking off the garment 700.

Further in FIG. 8, the chest band 704 provides elastic support under the wearer's breasts. The chest band 704 and bottom hem 721 drape downward to cover the torso below the wearer's bust. The chest band 704 encircles the garment to encircle the torso of the wearer and to hold the inner bodice 700*a* securely in place under the bust to provide a bra-like support. Further, the chest band 704 holds the breast-feeding openings 210, 212 in position to expose respective portions of the wearer's breasts for nursing an infant while wearing the inner bodice 700*a*.

Further in FIG. 7, the inner bodice 700*a* of the nursing garment 700 and its chest band 704 are covered by the outer bodice 106 that extends downward to cover the inner bodice 700*a* and the chest band 704. The outer bodice 106 can be pulled up in preparation for nursing, similarly as described above with reference to FIG. 2. After nursing on the one side is completed, the outer bodice 106 can be pulled down to cover the inner bodice 700*a* and provide support for the wearer's breasts.

Figure 9:
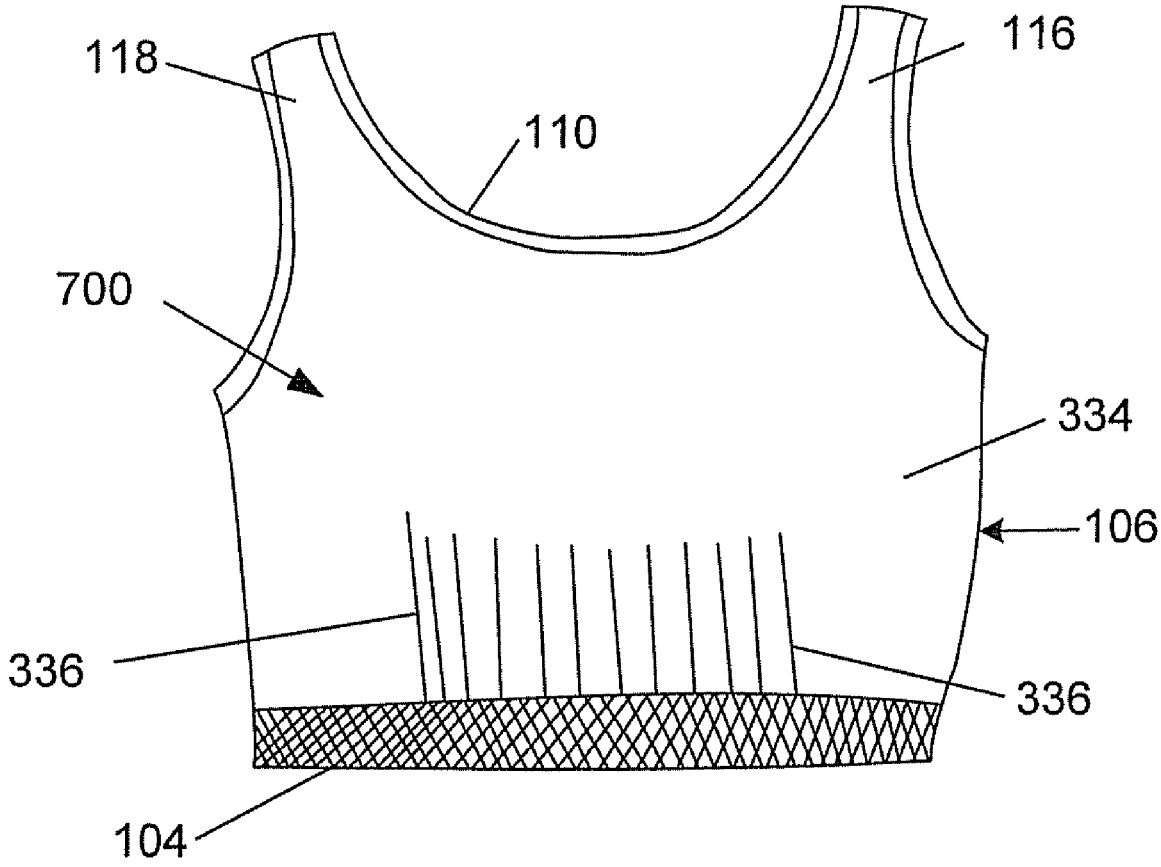
FIG. 9 is an elevation view of a back side of the nursing garment of FIG. 7.

FIG. 9 discloses the nursing garment 700 having a back side 334 of the outer bodice 106. A series of vertically extending stitches 336 are spaced apart from each other and are centered at about the center of the back side 334. The stitches 336 extend from about the chest band 104 of the outer bodice 106 and upward along the back side 334. The stitches constrict the back side 304 in a narrowed circumference to conform to the hollow anatomy, or small of the back, of the wearer of the nursing garment 700. The stitches 336 can further include stitched pleats, wherein the pleats further constrict the back side 304 in a narrowed circumference. The two direction orthogonal elastic stretch of the fabric of the back side 334 provides circumferential support of the wearer.

This description of the exemplary embodiments is intended to be read in connection with the accompanying drawings, which are to be considered part of the entire written description. In the description, relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

Patents and patent applications referred to herein are hereby incorporated by reference in their entireties. Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. A nursing garment, comprising:

an outer bodice and an inner bodice, wherein the outer bodice is adapted for pulling up to uncover the inner bodice and for pulling down to cover the inner bodice;

the inner bodice having breast-feeding openings and being adapted with curtains for drawing aside at the respective breast-feeding openings.

2. The nursing garment of claim 1 wherein the outer bodice provides breast support.

3. The nursing garment of claim 1 wherein a stretchable, torso encircling portion of the outer bodice provides breast support.

4. The nursing garment of claim 1 wherein a stretchable, torso encircling portion of the outer bodice provides breast support, and the torso encircling portion is chest band.

5. The nursing garment of claim 1 wherein the inner bodice is stretchable to provide breast support.

6. The nursing garment of claim 1 wherein the outer bodice has a center front elastic band providing breast support.

7. The nursing garment of claim 1 wherein the outer bodice has breast cups.

8. The nursing garment of claim 7 wherein the outer bodice provides breast support.

9. The nursing garment of claim 7 wherein a stretchable, torso encircling portion of the outer bodice provides breast support.

10. The nursing garment of claim 7 wherein a stretchable, torso encircling portion of the outer bodice provides breast support, and the torso encircling portion is chest band.

11. The nursing garment of claim 7 wherein the inner bodice is stretchable to provide breast support.

12. The nursing garment of claim 7 wherein the outer bodice has a center front elastic band providing breast support.

13. The nursing garment of claim 7 wherein the outer bodice has respective pockets for receiving the respective breast cups.

14. The nursing garment of claim 7 wherein the outer bodice has respective pockets with open tops for receiving the respective breast cups.

15. The nursing garment of claim 7 wherein the breast cups are comprised of an antibacterial composition.

16. The nursing garment of claim 1 wherein, the outer bodice has shoulder straps adapted for pulling down.

17. The nursing garment of claim 1 wherein, the outer bodice has shoulder straps adapted for pulling down, and the inner bodice has corresponding shoulder straps to hold the inner bodice up while breast-feeding an infant.

18. The nursing garment of claim 1, comprising:

a chest band, wherein the outer bodice joins the inner bodice along the chest band.

19. A method for using the nursing garment of claim 1, comprising: pulling up at least on one side of the outer bodice to uncover the breast-feeding openings through the inner bodice in preparation for breast-feeding; and pulling down the outer bodice to cover the inner bodice after completion of breast-feeding.

20. A nursing garment, comprising:

an outer bodice, the outer bodice having a front neckline and a back neckline;

and an inner bodice, the inner bodice having breast-feeding openings;

wherein the outer bodice is adapted for pulling up to uncover the inner bodice and for pulling down to cover the inner bodice; and wherein the outer bodice and the inner bodice are separate garments sewn together at the front neckline and the back neckline.

21. The nursing garment of claim 20, wherein one or more of the outer bodice and the inner bodice provide breast support.

22. The nursing garment of claim 20, wherein the outer bodice has breast cups.

23. The nursing garment of claim 22, wherein the outer bodice has respective pockets for receiving the respective breast cups.

24. The nursing garment of claim 20, wherein the outer bodice further comprises outer shoulder straps, wherein the inner bodice further comprises inner shoulder straps, and wherein the inner shoulder straps are sewn as linings to the outer shoulder straps.

25. A nursing garment, comprising:

an outer bodice, the outer bodice having a front neckline, a back neckline, and a chest band;

an inner layer;

a center front stitch that is vertically oriented from near the front neckline to near the chest band, wherein the center front stitch connects the outer bodice and the inner layer, and wherein the center front stitch partitions the inner panel into cup receiving pockets; and an inner bodice covered by the outer bodice, wherein the inner bodice is accessible by pulling up the outer bodice, the inner bodice comprising breast-feeding openings.

26. The nursing garment of claim 25, further comprising breast cups that are retained in and removable from the cup receiving pockets.

27. The nursing garment of claim 25, wherein the center front stitch comprises a stretchable and contractible material.

28. The nursing garment of claim 25, wherein one or more of the outer bodice, the inner bodice, and the center front stitch provide breast support.

* * * * *